US007028444B2

(12) United States Patent
Wirth

(10) Patent No.: US 7,028,444 B2
(45) Date of Patent: Apr. 18, 2006

(54) SUPPORT DEVICE FOR ORTHOGONAL MOUNTING OF SHEET MATERIAL

(76) Inventor: Timothy L. Wirth, 13863 N. Cassia St., Rathdrum, ID (US) 83858

( * ) Notice: Subject to any disclaimer, the term of this patent is extended or adjusted under 35 U.S.C. 154(b) by 0 days.

(21) Appl. No.: 10/412,197

(22) Filed: Apr. 11, 2003

(65) Prior Publication Data

US 2004/0200184 A1 Oct. 14, 2004

(51) Int. Cl.
*E04C 2/38* (2006.01)

(52) U.S. Cl. ..... 52/718.01; 52/717.05; 52/461

(58) Field of Classification Search ..... 52/718.01, 52/717.05, 417, 461, 468, 471, 586.2, 582.1, 52/211, 412
See application file for complete search history.

(56) References Cited

U.S. PATENT DOCUMENTS

| | | | | |
|---|---|---|---|---|
| 3,429,084 A | | 2/1969 | Brewer | |
| 3,638,374 A | * | 2/1972 | Harby | 52/100 |
| 3,871,787 A | * | 3/1975 | Stegmeier | 404/48 |
| 3,994,471 A | * | 11/1976 | Turolla | 249/205 |
| 4,102,093 A | | 7/1978 | Harris | |
| 4,157,271 A | * | 6/1979 | Moore | 156/71 |
| 4,809,459 A | * | 3/1989 | Brylla et al. | 47/33 |
| 4,971,849 A | * | 11/1990 | Azzar | 428/100 |
| 5,021,279 A | | 6/1991 | Whitener | |
| 5,167,579 A | | 12/1992 | Rotter | |
| 5,475,953 A | * | 12/1995 | Greenfield | 52/179 |
| 5,487,250 A | * | 1/1996 | Yount et al. | 52/417 |
| 5,581,964 A | | 12/1996 | Pizer | |
| 5,598,673 A | | 2/1997 | Atkins | |
| 6,112,476 A | | 9/2000 | Schulenburg | |
| 6,308,473 B1 | | 10/2001 | Auck | |
| 6,658,808 B1 | * | 12/2003 | Doherty et al. | 52/580 |
| 2003/0192278 A1 | * | 10/2003 | Snyder et al. | 52/474 |

FOREIGN PATENT DOCUMENTS

WO 9419554 9/1994

OTHER PUBLICATIONS

"OIKOS Drywall Backers", Oct. 1993, Energy Source Builder #29, pp. 1-2.*
http://www.thenailer.com/installation.htm; The Nailer—A Drywall Fastener for Supporting Interior Corners, Easy as 1-2-3, Oct. 7, 2004, one page.
http://www.thenailer.com/articlesaboutthenailer.htm; The Nailer—A Drywall Fastener for Supporting Interior Corners, American How To Magazine, Oct. 7, 2005, 2 pages.

* cited by examiner

*Primary Examiner*—Naoko Slack
(74) *Attorney, Agent, or Firm*—Dorsey & Whitney LLP

(57) ABSTRACT

A sheet material support device that is attachable to studs, joist, beams or other suitable framing components and that facilitates mounting orthogonal junctions of sheet material pieces without need of multiple studs is described. The device includes a fastener-receiving member used to fasten the sheet material to the device and a stud-mounting member orthogonally transecting the fastener-receiving member that is used for mounting the device on the stud. The sheet material support device is made of a pliable plastic material and can be quickly mounted to the studs through the stud-mounting member using an ordinary construction grade staples. Each of two orthogonally oriented sheet materials forming the junction are quickly mounted by being fastened through the stud-mounting member into the stud in one case and into the fastener-receiving member in the other case.

30 Claims, 6 Drawing Sheets

SUPPORT DEVICE FOR ORTHOGONAL MOUNTING OF SHEET MATERIAL

TECHNICAL FIELD

This invention relates generally to sheet material construction aids, and more specifically to a device and methods for mounting dry wall that eliminates the need for multiple studs at orthogonal junctions of sheet material.

BACKGROUND OF THE INVENTION

In the construction industry, particularly the residential construction industry, the most common materials for finishing walls, floors and ceilings are sheet materials, exemplified by drywall, plywood, wall board, paneling and the like. By far the most common material for finishing interior walls and ceilings is drywall. Drywall, like other sheet materials is typically "hung" by being fastened directly to framing components such as studs or joists that are assembled to form the skeleton of a housing frame. Such studs or joists are typically made of framing grade lumber dimensioned as 2"×4", 2"×6" or 2"×8" pieces and the drywall is hung by screwing or nailing the sheet directly into the studs or joists.

FIG. 1 illustrates the use of studs and joist according to the prior art. FIG. 1A shows an example floor plan for a residence illustrating the placement and location of studs 20 and a plurality of corners 31 and intersections 33 that define an interior space. In the construction industry, the distance between the center points of adjacent studs is fixed at a standardized length, typically 16 inches, except at corners and intersections. The typical arrangement of studs 20 at a corner 31 or at an intersection 33 is detailed in FIGS. 1B and 1C, respectively. In the typical arrangement, three studs 20 are required to establish the mounting surfaces for making the perpendicular turns. In a corner, stud 20*a* serves as the fastening surface for the end of the sheet material hung along wall A, stud 20*b* serves as the fastening surface for the end of the sheet material hung along wall B, and stud 20*c* serves as a corner stud to define the end of the corner and stud 20*d* serves merely to maintain the standard spacing between studs. In the case of an intersection 33, there are two equivalents of stud 20*a* on either side of wall B along with stud 20*b*.

While this standard construction technique has enjoyed much success and is practice throughout the industry, it is wasteful with respect to the amount of wood needed to provide the mounting surfaces, especially for orthogonal junctions between sheet materials.

There have been some efforts in the industry to reduce the use of lumber or to otherwise facilitate the process of hanging sheet material. For example, U.S. Pat. No. 5,651,225 discloses a metal bracket that may be used as a substitute for studs for flush mounting of adjacent dry wall pieces across a flat surface. The bracket contains two extended flanges with pre-drilled screw holes and an intermediate rib portion that lies perpendicular to the flanges. The rib portion has a height that is purposefully set to be less than the thickness of the drywall material so that when two adjacent pieces of drywall are fastened to the flanges on either side of the rib, no part of the rib protrudes and the joint can be easily hidden with finishing tape and compound. While, the bracket disclosed in U.S. Pat. No. 5,651,225 may be useful for joining adjacent pieces of drywall on a flat surface, it is not suitable for joining pieces of drywall that intersect at orthorgonal angles, such as the perpendicular angles of a corner, a junction between a ceiling and a wall, or a room intersection.

Accordingly, there remains a need in the art to provide devices and methods that facilitate sheet material mounting and that reduce the requirements for studs, particularly those used at orthogonal junctions of framing.

SUMMARY OF THE INVENTION

There is provided a sheet material support device that is attachable to studs, joist, beams or other framing components and that facilitates mounting orthogonal junctions of sheet material pieces without need of multiple studs at the junction. In one embodiment, the device comprises a fastener-receiving member having a first thickness and a stud-mounting member having a second thickness less than the first thickness. The stud mounting member extends orthogonally away from the fastener receiving member and has a proximal end that transects the fastener receiving member into a first angular section configured to fit onto corner surfaces of a stud and a second angular section configured to receive the sheet material in an orthogonally disposed orientation relative to the fastener receiving member. The stud mounting member also has a distal edge extended away from the proximal end by a width that is greater than a thickness of the sheet material so that when the first angular section is mounted on a stud via the stud mounting member and sheet material is mounted to the fastener receiving member in the orthogonally disposed orientation, a portion of the stud mounting member remains exposed on the stud above the surface of the mounted sheet material.

In another embodiment the sheet material support device includes a fastener-receiving member having a first thickness and a stud-mounting member having a tapered cross sectional thickness less than the first thickness. The stud mounting member extends orthogonally away from the fastener receiving member and has a proximal end that transects the fastener receiving member into a first angular section configured to fit onto corner surfaces of a stud and a second angular section configured to receive the sheet material in an orthogonally disposed orientation relative to the fastener receiving member. The stud-mounting member has a distal edge extended away from the proximal end and the distal edge is thicker in cross section than the proximal end thereby defining the tapered cross section.

In various embodiments the sheet material support device is preferably integrally constructed and made of a pliable plastic material that is molded or extruded. These embodiments may further include a flame retardant.

Also provided are methods for mounting sheet material that include the acts of mounting the device according to any of the embodiments of the invention to at least one of a stud, joist or beam and mounting a first piece of sheet material to the fastener receiving member of the device. The typical method also includes mounting a second piece of sheet material to the device in an orthogonal orientation with respect to he first piece of sheet material.

BRIEF DESCRIPTION OF THE DRAWINGS

FIG. 1 depicts corner stud mounting components of the prior art.

FIG. 3 shows top views of the sheet material support device of the present invention mounted on studs and the position of the sheet materials.

DETAILED DESCRIPTION OF PREFERRED EMBODIMENTS

Figure 1A:
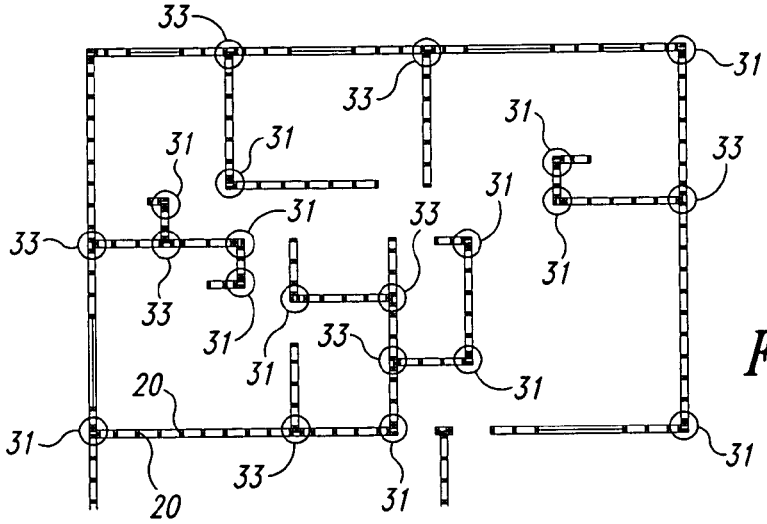
FIG. 1A shows an exemplary floor plan for a residence.

A detailed description of the present invention is best provided by reference to the figures. Throughout the description, the invention is illustrated in the context of conventional vertically disposed framing studs, however, the invention is equally applicable to any framing component used to form an orthogonal junction in any orientation, including beams and joist that are horizontally disposed. FIG. 2 is a top cross-sectional view of representative embodiments of a sheet material support device 10 provided herein. Each sheet material support device 10 has a fastener receiving member 14 transected by a stud mounting member 12 that extends orthogonally from the fastener receiving member 14, thereby defining a first angular section 19 and a second angular section 21 located on either side of the stud mounting member 12. The first angular section 19 is defined by a lateral portion 13*a* of the fastener receiving member 14 and a back surface 17 of the stud-mounting member 12. The second angular section 21 is defined by a second lateral portion 13*b* of the fastener receiving member 14 and a front surface 11 of the stud-mounting member 12. When mounted on the corner of a stud 20 (see FIG. 3) the first lateral portion 13*a* of the fastener receiving member 14 contacts a lateral side 9 of a stud 20 and the back surface 17 of the stud mounting member 12 contacts a front mounting surface of the stud 20.

In the most typical embodiments for perpendicular corners and intersections, the stud fastener receiving member 14 is linear and the stud mounting member 12 is perpendicular to the fastener receiving member 14 so that the first angular section 19 and the second angular section 21 are both right angle sections as illustrated in FIGS. 2A–2D. In other embodiments, illustrated in FIG. 2E, the fastener receiving member 14 is bent outwardly at an angle and the stud mounting member 12 intersects the fastener receiving member so that the first angular section 19 is perpendicular while the second angular section 21 is obtuse. Embodiments with this design are useful for mounting sheet material in corners or intersections that are not perpendicular, for example at the junction between a wall and an upwardly sloping ceiling.

The width Wf of the fastener receiving member 14 is selected so that lateral portion 13*b* provides a sufficient contact area to receive a plurality of screws, nails or other fasteners, while lateral portion 13*a* provides sufficing contact with the lateral side 9 of the stud 20 (see FIG. 3) so that when the sheet material support device 10 is mounted on the corner of a stud (see FIG. 5) and pressure is applied against lateral portion 13*b* when attaching a fastener, lateral section 13*a* resists the torque moment that will result along the axis of intersection between the fastener receiving member 14 and the stud mounting member 12. In typical embodiments, the width Wf of the fastener receiving member 14 is about 1 to about 6 inches, about 1.25 to about 3 inches, about 1.5 to about 2 inches and most typically about 1.6 inches. The width of lateral portions 13*a* and/or 13*b* is about 0.5 to about 3 inches, about 0.75 to about 1 inches and most typically about 0.8 inches. The width of lateral portion 13*a* may be the same as, longer than or shorter than the width of lateral portion 13*b*, depending on where the stud mounting member 12 intersects the fastener receiving member 14.

The stud-mounting member 12 has a proximal end 16 that intersects the fastener receiving member 14 and a distal edge 18 opposite the proximal end 16, and which is extended away from the fastener-receiving member 14. The distance between the proximal end 16 and the distal edge 18 defines a width $W_M$ of the stud-mounting member 12. With reference to FIG. 3, one important feature of the invention is that the width $W_M$ of the stud mounting member 12 is selected to be greater than a thickness $W_D$ of the sheet material 30A but less than the width $W_S$ of the mounting surface 15 of the stud 20. This permits a portion of the stud mounting member 12 to remain exposed on the stud 20 after the sheet material 30 has been fastened to the fastener receiving member 14 while also leaving a section of the stud 20 exposed for receieving an orthogonally mounted second piece of sheet material 30B as will be described in more detail hereafter. In embodiments particularly useful for dry wall mounting, the width $W_M$ of the stud mounting member 12 is typically at least 0.6 inches, more typically at least 1 inch, most typically about 1 to about 1.5 inches and still most typically about 1.25 inches.

Advantageously, in preferred embodiments sheet material support device 10 is made of a pliable material, preferably a plastic, and most preferably a molded or extruded plastic. Suitable plastics for the sheet material support device 10 include, but are not limited to polystyrene, polypropylene, high density polyethylene, polyvinyl chloride, acrylic, styrofoam and composites of the same. Embodiments made of plastic may further include a suitable flame retardant such as Broming™ plus ammonium oxide in a suitable amount. Other embodiments may use a pliable or ductile metal such as tin, aluminum, steel, brass and the like. Still other suitable materials include fiberglass, carbon fiber materials and composites that include the same, resins and thermoplastic copolymers. The material should have sufficient hardness and resilience to securely hold a fastener. Typically, when the material is made of a plastic the Shore D durometer hardness of the plastic should be at least 5, preferably at least 10 and more preferably at least 15 and most preferably in the range of about 20 to 50. The material should also have sufficient tensile strength to maintain the shape and structural integrity of the sheet material support device 10 when pressure is applied against the device during mounting of the sheet material with a fastener. The material should further be pliable enough to conform the length of the device to the edges of the studs 20, which typically may be bowed or otherwise out of true alignment along the length of the stud. In preferred embodiments, the fastener receiving member 14 and the stud mounting member 12 are integrally formed, however, in other embodiments, these two components can be formed separately and then joined to one another by a suitable bonding, adhering or fastening process.

The fastener-receiving member 14 has a first thickness T1 that is sufficient for securely receiving a fastener 22 such as a nail 23, screw 24 or other fastener bearing a fractional portion of the weight of the sheet material 30 when the sheet material 30 is fastened to the fastener-receiving member 14. The first thickness T1 of the fastener-receiving member 14 will be determined by the type of material of which the sheet material support device 10 is made, the type of sheet material 30 to be mounted and the type of fastener 22 to be used. In exemplary embodiments where the sheet material support device is 10 is made of a plastic material for mounting residential dry wall, a suitable thickness T1 for the fastener receiving member 14 is about 0.063 to 0.5 inches, more typically about 0.125 to 0.25 inches and most typically about 0.19 inches.

Figure 3A:
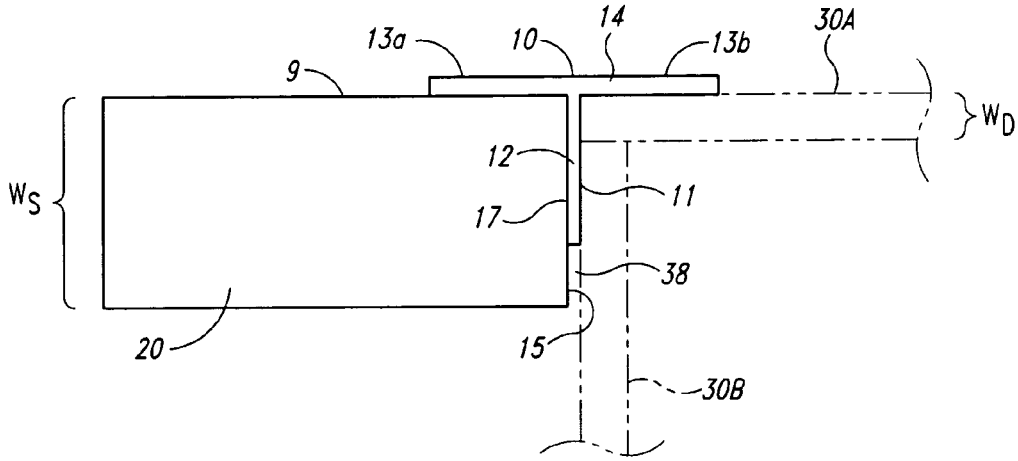
FIG. 3A depicts a non-tapered embodiment and FIG. 3B depicts a tapered embodiment.

The stud-mounting member 12 has a second thickness T2 that is less than the first thickness T1 of the fastener-receiving member 14. The second thickness T2 should be as thin as possible while yet being as thick as needed to maintain the structural integrity of the stud mounting member 12 when it is mounted to the stud 20 using a fastener 26. Thinness of the stud mounting member 12 is desirable because when the second piece of sheet material 30B is mounted to the stud 20, the stud mounting member 12 is disposed between the back surface of the sheet material 30B and the stud, which will cause an unwanted offset 38 of the sheet material 30B away from the mounting face 15 of the stud 20 as illustrated in FIG. 3A. Also, for rapid mounting, it is preferable that the stud-mounting member 12 be mounted to the stud 20 using staples of about 0.25 to 1 inches in depth and preferably about 0.5 inches in depth, the staples having a crown width of 0.25 to about 1 inch, preferably about 1 inches delivered from a construction grade staple gun delivering about 40 to about 80 lbs but not exceeding about 100 lbs of pressure from a compressed air source. Although use of staples is preferred, the invention may be practiced with any suitable fastener including conventional screws and nails. The smaller the second thickness T2 the more easily the stud mounting member 12 can be mounted to the mounting surface 15 of the stud 20. On the other hand, the second thickness T2 of the stud-mounting member 12 must be sufficient to securely receive the fastener without tearing away from the fastener-receiving member 14. In example embodiments where the sheet material support device 10 is made from a plastic, a resin, a fiber or a thermoplastic co-polymer, a suitable thickness T2 for the stud-mounting member 12 is between about 0.025 and 0.25 inches, more preferably between about 0.04 and 0.125 inches and most preferably about 0.06 to 0.08 inches.

Figure 3B:
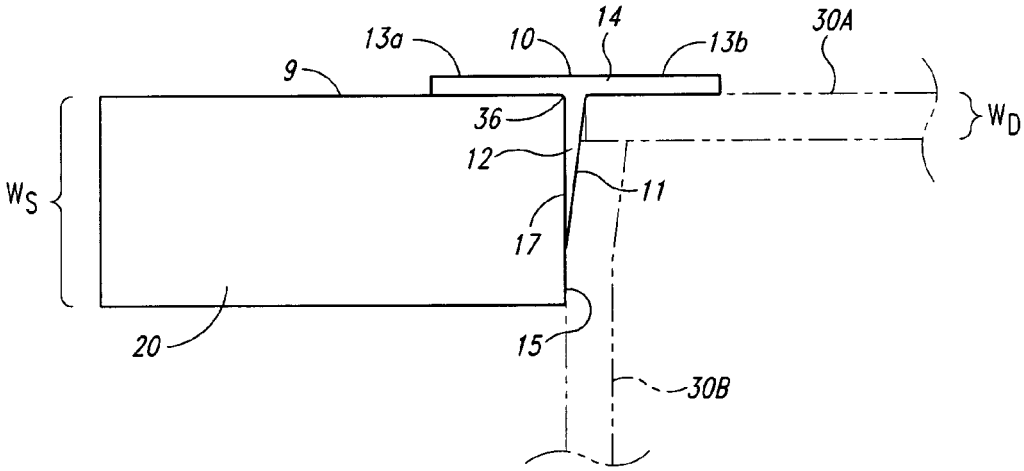

In preferred embodiments, as illustrated in FIGS. 2A–2C and 2E, the stud mounting member 12 has a tapered cross section that is thicker at the proximal end 16 than at the distal edge 18. The tapered cross section provides several advantages that are illustrated with reference to FIG. 3B. First, the thicker portion near the proximal end 16 provides a more sturdy structure at the point of intersection of the stud-mounting member 12 with the fastener receiving member 14. Second, the tapered cross section is typically somewhat curvilinear at the proximal end 16 and helps provide material to fill small voids caused by a camber 36 in the stud 20, i.e., unwanted rounding of corners that occurs in most construction grade lumber. Third, the tapered cross section minimizes the offset 38 of the sheet material 30B from the mounting face 15 of the stud 20, particularly at the distal edge 18 of the stud-mounting member 12. As shown in FIG. 3B, the taper provides a direct contact between the sheet material 30B and the mounting face 15 of the stud 20 at that portion of the stud that remains exposed after the stud mounting member 12 is mounted to the stud 20. While the taper causes a slight out-of square bowing of the sheet material 30B at the junction with the sheet material support device 10 (exaggerated in FIG. 3B for purposes of illustration) the bowing is very small and is neither noticeable nor detrimental to the structural integrity of the construction. In typical embodiments where the sheet material support device 10 is made from a plastic, a resin, a fiber or a thermoplastic co-polymer, the tapered cross section of the stud mounting member 12 is about 1° to about 10°, about 2° to about 5° or more typically about 30 off true. The thickness at the proximal end 16 is about 0.08 to 0.25 inches, about 0.1 to 0.15 inches or most typically about 0.125 inches. The thickness at the distal edge 18 is about 0.02 to 0.1 inches, or about 0.04 to 0.08 inches and most typically about 0.062 inches.

Figure 4A:
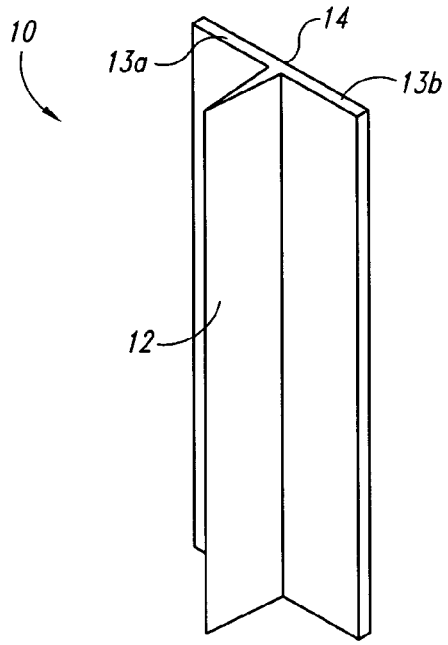
FIG. 4 shows orthogonal views of various embodiments of the sheet material support device of the invention.
Figure 4B:
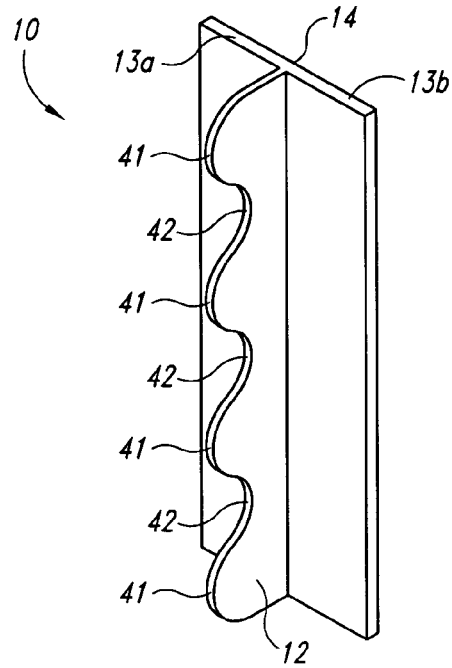
Figure 4C:
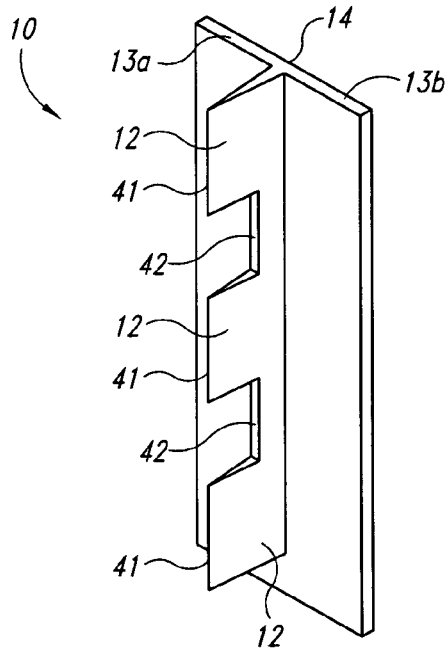
Figure 4D:
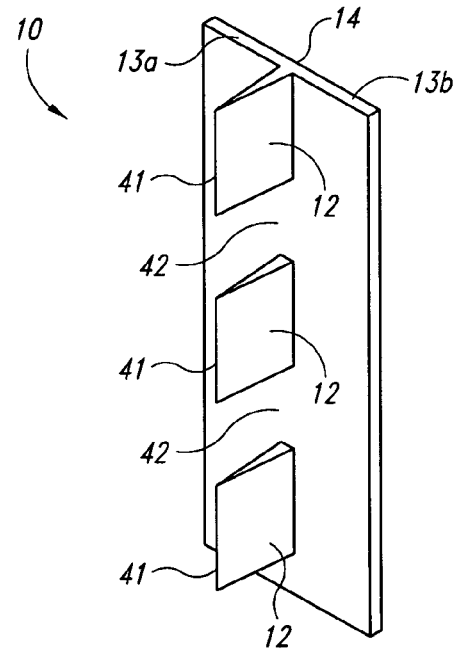

FIGS. 4A–4C show a front isometric view of various exemplary embodiments of the sheet material support device 10. In the embodiment illustrated in FIG. 4A the width $W_M$ of the stud mounting member 12 between the proximal end 16 and the distal edge 18 is constant along an entire length L of the sheet material support device 10. In the embodiments shown in FIGS. 4B and 4C the $W_M$ of the stud mounting member 12 is varied along the length L of the sheet material support device 10 in alternating increments of greater 41 and lesser 42 widths. In the embodiment illustrated in FIG. 4B, the alternating increments of the width form a multiple humped like (bactrian) aspect when viewed from the side. In the embodiment illustrated in FIG. 4C, the alternating increments form a notch and tooth aspect. These embodiments with alternating widths 41 and 42 are useful for saving in material costs of manufacture without disturbing the functional performance of the sheet material support device 10. The portions of the stud-mounting member 12 having the greater widths 41 are used to receive the staple 26 or other fastener for mounting the stud-mounting member 12 to the stud 20. The portions of the stud-mounting member 12 having the lesser width 42 are not used to receive a fastener and therefore need not be as wide as the portions that receive the fastener. In the embodiment shown in FIG. 4D, the portions of lesser width 42 in-fact, have a width of zero, so that the stud mounting member 12 is in effect, comprised of a plurality of wider sections 41 separated by gaps. The smaller widths or gaps also facilitate bending of the sheet material support device 10 along a longitudinal line to follow the edges of the stud 20.

Figure 5:
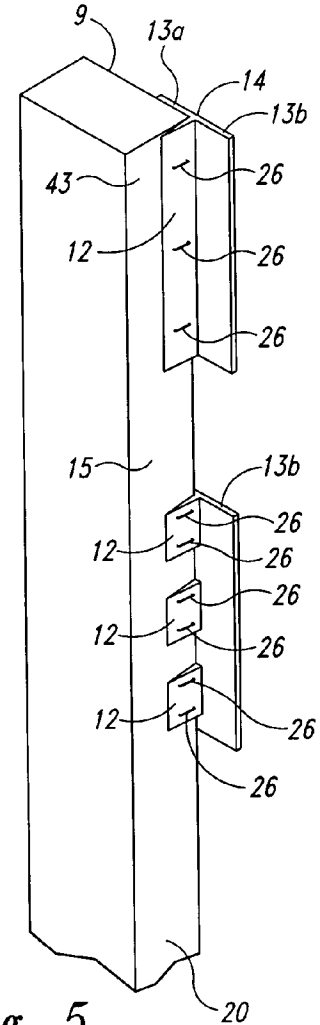
FIG. 5 shows an orthogonal view of the sheet material support devices of the invention mounted on a stud.

The length L of the sheet material support device can be selected according to need. In one embodiment, the length L is selected to be same as the length of studs 20 used for framing and only one sheet material support device 10 is mounted to the stud. A typical length for this purpose used in residential construction is 96 inches. In more preferred embodiments the length L is less than the length of the stud 20 and multiple sheet material support devices 10 are mounted to the stud 20 as illustrated in FIG. 5. Suitable lengths L for the sheet material support device 10 are between about 6 inches and a about 48 inches, more typically between about 16 inches and 36 inches, and most typically about 26 inches.

FIG. 5 is an isometric view of two embodiments of the sheet material support device 10 mounted to the corner of a stud. The upper sheet material support device 10 represents an embodiment with a constant width $W_M$ for the stud-mounting member 12 while the bottom sheet material support device 10 represents a toothed embodiment where the width of the stud-mounting member 12 alternates. In either case, the sheet material support device is mounted to the mounting face 15 of the stud 20 by suitable fastener exemplified by the staples 26. The first lateral portion 13*a* of the fastener receiving member 14 lies against the lateral surface 9 of the stud 20. The first lateral portion 13*a* of the fastener receiving member 14 can optionally be fastened to the lateral surface 9 of the stud 20 using screws or nails, however, in ordinary use, it is not necessary to additionally fasten the fastener receiving member 14 to the stud 20 because the mounting of the corner with fasteners through the sheet material 30B (see FIGS. 3 and 6) provides sufficient support. The width $W_M$ of the stud-mounting member 12 is such that in mounting the sheet material support device 10 to the mounting face 15 of the stud 20, a portion of the stud 43 between the distal edge 18 of the stud mounting member 12 and the outer edge 29 of the mounting face 15 remains exposed.

Figure 6:
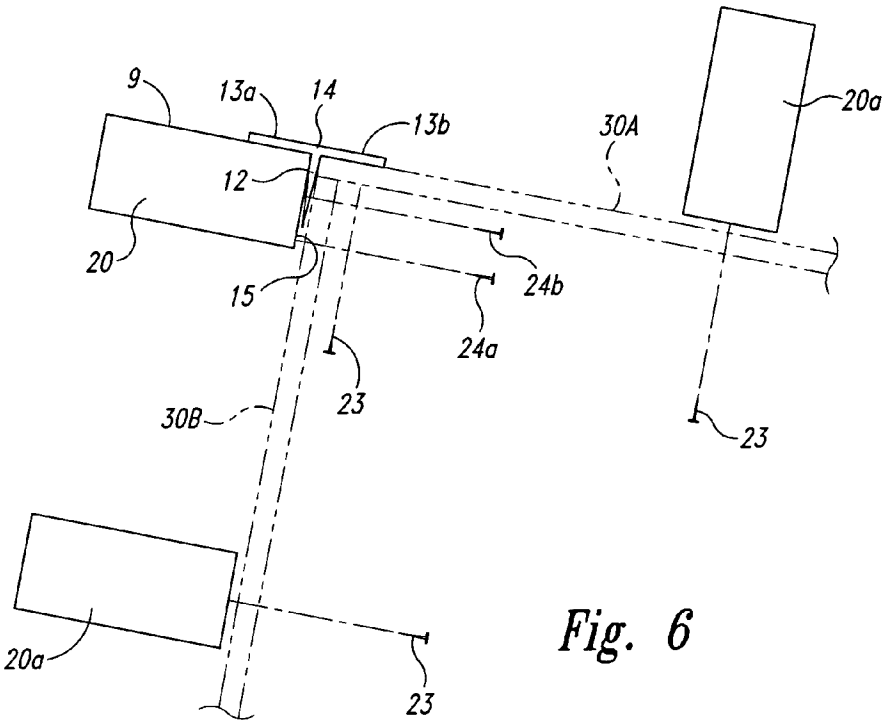
FIG. 6 is a top view depicting mounting of sheet materials using the device of the invention.

FIG. 6 is top view of a corner made of orthogonally disposed sheet materials 30A and 30B assembled using the sheet material support device 10 of the present invention. After the sheet material support device 10 is mounted to a corner stud 20, the first sheet material 30B is fastened to the stud 20 using a suitable fastener such as screws 24*a* and 24*b*. The screw 24*a* is introduced into the stud 20 through the exposed portion 45 of the stud or through the stud-mounting member 12. In practice, a plurality of screws 24 are used to fasten the sheet material 30B to the stud and optionally, screws 24*a* are fastened through the exposed portion 45 while screws 24*b* are fastened through the stud mounting member 12. The second piece of sheet material 30A is mounted orthogonally to the first piece of sheet material 30B by introducing fasteners 23*a* through the second piece of sheet material and into the second lateral portion 13*b* of the fastener receiving member 14. The order of mounting the sheet material pieces 30A and 30B of course can also be reversed, where the sheet material piece 30A is mounted to fastener receiving member 14 first, followed by mounting sheet material piece 30B as described above. It should be noted that the sheet material support device 10 bears only a fraction of the weight of the sheet material pieces 30A and 30B because each piece is also mounted to the other studs 20*a* along the wall in conventional fashion. Thus, staples 26 (FIG. 5) are sufficient for mounting the sheet material support device 10 to the stud 20, especially when one or more fasteners 24*a* and 24*b* are also introduced into corner stud 20 through the stud-mounting member 12.

Figure 1B:
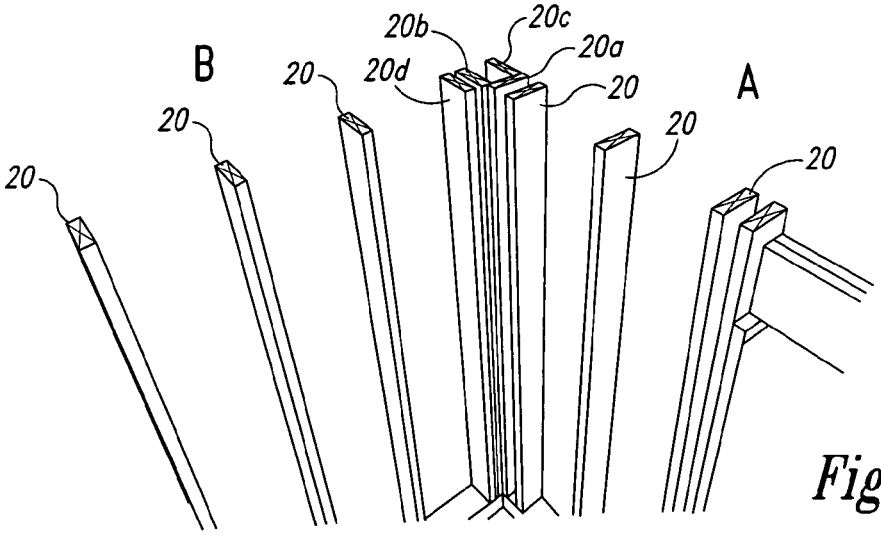
FIG. 1B shows studs for a typical corner junction and FIG. 1C shows studs for a typical intersection junction.
Figure 1C:
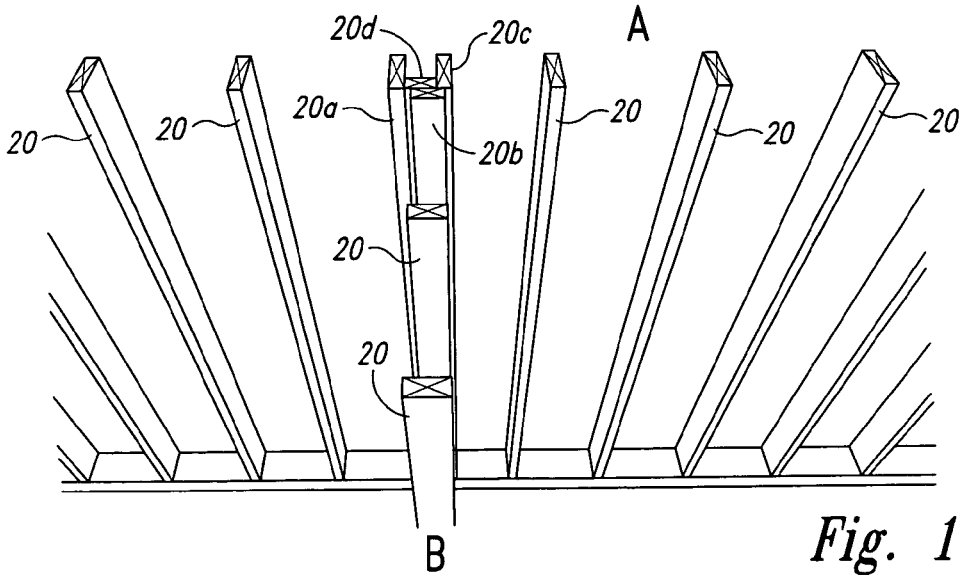
Figure 2A:
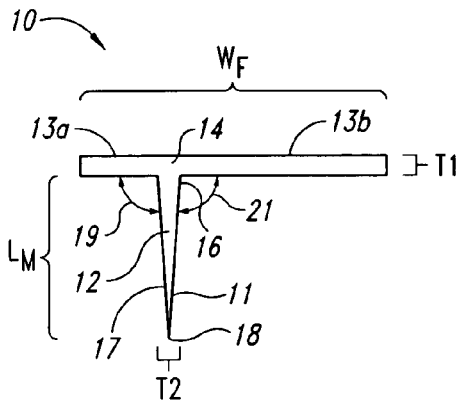
FIG. 2 shows top cross sectional views of various embodiments of the sheet material support device of the present invention.
Figure 2B:
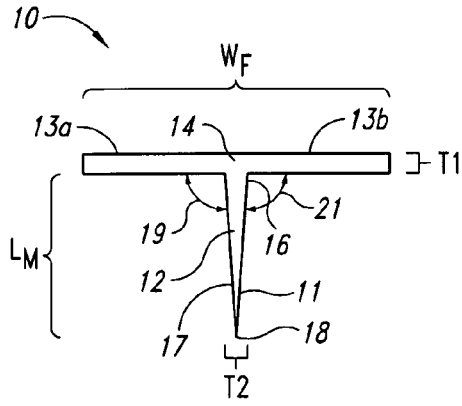
Figure 2C:
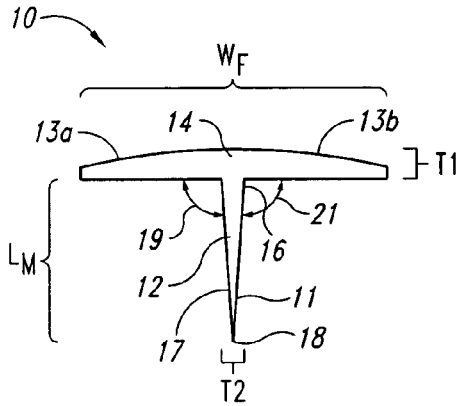
Figure 2D:
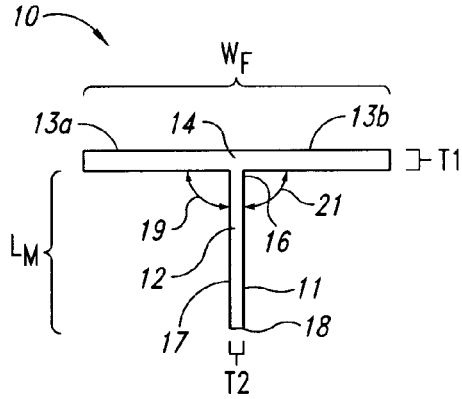
Figure 2E:
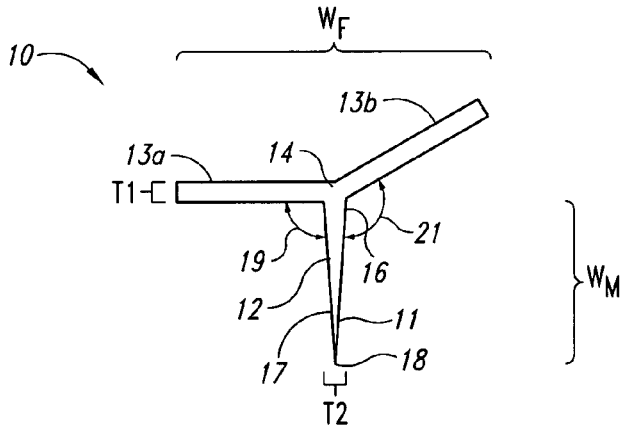
Figure 7A:
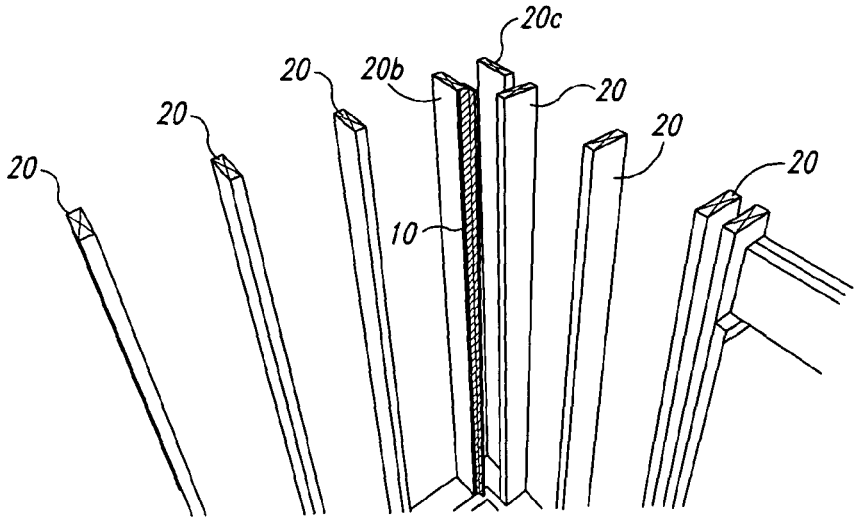
FIGS. 7A and 7B depict corner and intersection junctions, respectively, using the sheet material support device of the invention as a comparison to the prior art depicted in FIG. 1.
Figure 7B:
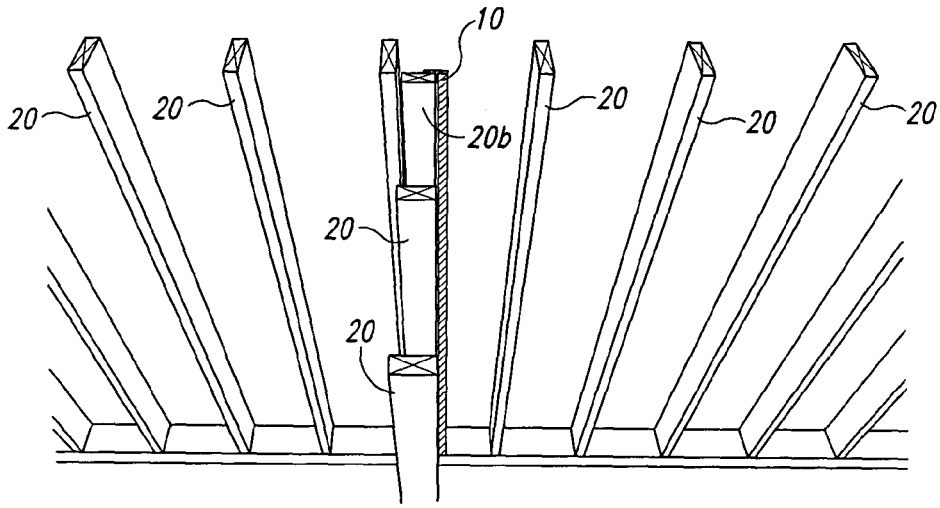

FIG. 7, illustrates the savings in stud material provided by the sheet material support device 10 of the present invention when compared to the conventional system of the prior art depicted in FIG. 1. FIG. 7A shows that when corner stud 20*b* is mounted with the sheet material support device 10, there is no need for the additional corner studs 20*a* nor even stud and 20*d* as used in the prior art. Similarly FIG. 7B shows that only end stud 20*b* configured with the sheet material support device 10 is needed to provide intersection junction 33, eliminating the need for both studs 20*a* and possibly 20*d*. This results in a substantial savings in labor and stud cost for a floor plan exemplified in FIG. 1 where there are 29 corners and/or intersections that must be assembled. Moreover, as mentioned herein before, the sheet material support device 10 can be oriented horizontally on a joist or beam to assemble orthogonal corners for a ceiling-wall junction, thus providing even more savings in costs.

The invention has been described with reference to certain preferred embodiments provided for illustrative purposes, however, the invention is not limited thereto except in accordance to the following claims.

What is claimed is:

1. A sheet material support device-stud-sheet material assembly, comprising:

at least one sheet material support device comprising:

a fastener receiving member and a stud mounting member extending away from the fastener receiving member to define first and second recesses on opposing sides of the stud mounting member, the stud mounting member having a proximal end attached to the fastener receiving member and a distal end, the stud mounting member continuously tapers from the proximal end to the distal end; and a stud received by the first recess of the at least one sheet support device and attached to the stud mounting member; and first and second sheet materials received by the second recess of the at least one sheet support device and positioned in a generally orthogonal relationship with each other, a face of the first sheet material attached to the fastener receiving member and a face of the second sheet material attached to the stud mounting member.

2. The assembly of claim 1 wherein the stud mounting member is attached to the fastener receiving member proximate a centerline thereof.

3. The assembly of claim 1 wherein the fastener receiving member and the stud mounting member are integrally formed from a pliable plastic material.

4. The assembly of claim 3 wherein the fastener receiving member and the stud mounting member comprises an extruded plastic piece.

5. The assembly of claim 3 wherein the fastener receiving member and the stud mounting member comprises a molded plastic piece.

6. The assembly of claim 3 wherein the plastic material includes a flame retardant.

7. The assembly of claim 1 wherein the first sheet material is attached to the fastener receiving member using at least one of a screw and a nail.

8. The assembly of claim 1 wherein the stud mounting member is attached to the stud using at least one staple.

9. The assembly of claim 1 wherein a portion of second sheet material abutting the stud mounting member bows away from the stud.

10. The assembly of claim 1 wherein a width between the distal end and the proximal end of the stud mounting member is varied along a length of the at least one sheet material support device in alternating increments of greater and lesser widths.

11. The assembly of claim 10 wherein the varied width and altering increments form a bactrian aspect.

12. The assembly of claim 10 wherein the varied width and altering increments form a notch and tooth aspect.

13. The assembly of claim 10 wherein the varied width and altering increments forms a plurality of stud mounting members separated by gaps along the length of the at least one sheet material support device.

14. The assembly of claim 1 wherein the stud mounting member is perpendicular to the fastener receiving member.

15. The assembly of claim 1 wherein the stud-mounting member is perpendicular to a first portion of the fastener-receiving member and obtuse to a second portion of the fastener-receiving member.

16. The assembly of claim 1 wherein the sheet material support device has length from a top end to a bottom end of about 12 inches to about 36 inches.

17. The device of claim 1 wherein the width between the distal edge and the proximal end of the stud mounting member is varied along a length of the sheet material support device in alternating increments of greater and lesser widths.

18. The assembly of claim 1 wherein the at least one sheet support device extends along substantially the entire length of the stud.

19. The assembly of claim 1 wherein the fastener receiving member and the stud mounting member define an elongated body having a longitudinal axis oriented so it is generally parallel with the length of the stud.

20. The assembly of claim 1 wherein the fastener receiving member and the stud mounting member define a body having a generally T-shaped cross-sectional shape.

21. The assembly of claim 1, further comprising at least one fastener extending through the second sheet material and into the stud without extending through the stud mounting member.

22. A sheet material support device-stud-sheet material assembly, comprising:

at least one sheet material support device comprising:

an elongated body having a longitudinal axis, the body including a fastener receiving member and a stud mounting member extending away from the fastener receiving member to define first and second recesses on opposing sides of the stud mounting member; and a stud received by the first recess of the at least one sheet support device and attached to the stud mounting member, the longitudinal axis of the at least one sheet material support device generally parallel to the length of the stud; and first and second sheet materials received by the second recess of the at least one sheet material support device and positioned in a generally orthogonal relationship with each other, a face of the first sheet material attached to the fastener receiving member and a face of the second sheet material attached to the stud mounting member.

23. The assembly of claim 22 wherein the fastener receiving member and the stud mounting member are integrally formed of a pliable plastic material.

24. The assembly of claim 23 wherein the fastener receiving member and the stud mounting member comprises an extruded plastic piece.

25. The assembly of claim 23 wherein the fastener receiving member and the stud mounting member comprises a molded plastic piece.

26. The assembly of claim 23 wherein the plastic material includes a flame retardant.

27. The assembly of claim 22 wherein the at least one sheet support device extends along substantially the entire length of the stud.

28. The assembly of claim 22, further comprising at least one fastener extending through the second sheet material and into the stud without extending through the stud mounting member.

29. The assembly of claim 22 wherein the body has a generally T-shaped cross-sectional shape.

30. The assembly of claim 22 wherein the sheet material support device has length from a top end to a bottom end of about 12 inches to about 36 inches.

* * * * *